US006931803B1

(12) United States Patent
Davis et al.

(10) Patent No.: US 6,931,803 B1
(45) Date of Patent: Aug. 23, 2005

(54) MODULAR BUILDING SYSTEM

(76) Inventors: Gary Davis, 19300 Gottardj Rd., North Fort Myers, FL (US) 33917; Wayne Catlett, 287 Chalmer Dr., North Fort Myers, FL (US) 33917

( * ) Notice: Subject to any disclaimer, the term of this patent is extended or adjusted under 35 U.S.C. 154(b) by 16 days.

(21) Appl. No.: 10/385,141

(22) Filed: Mar. 10, 2003

Related U.S. Application Data

(60) Provisional application No. 60/362,766, filed on Mar. 8, 2002.

(51) Int. Cl.[7] ..... E04B 2/08; E04B 1/00

(52) U.S. Cl. ..... 52/251; 52/271; 52/589.1; 52/590.2; 52/592.4; 52/592.5; 52/592.6

(58) Field of Search ..... 52/251, 271, 589.1, 52/590.1, 590.2, 592.4, 592.5, 592.6

(56) References Cited

U.S. PATENT DOCUMENTS 669,591 A * 3/1901 Penney ..... 52/589.1 X
781,746 A * 2/1905 Sheldon et al. ..... 52/271
1,841,233 A * 1/1932 Whiting ..... 52/592.5
2,947,040 A * 8/1960 Schultz ..... 52/592.4
4,084,363 A * 4/1978 Moore ..... 52/251 X
4,269,006 A * 5/1981 Larrow ..... 52/592.6 X
4,299,069 A * 11/1981 Neumann ..... 52/592.6 X
4,304,080 A * 12/1981 Freeman ..... 52/592.6 X
4,388,361 A * 6/1983 Vassalli ..... 52/592.6 X
4,532,745 A * 8/1985 Kinard ..... 52/251
4,823,534 A * 4/1989 Hebinck ..... 52/251 X
4,924,641 A * 5/1990 Gibbar, Jr. ..... 52/251 X
5,231,813 A * 8/1993 Drawdy ..... 52/251 X
5,361,556 A * 11/1994 Menchetti ..... 52/271 X
5,983,585 A * 11/1999 Spakousky ..... 52/590 X
6,065,262 A * 5/2000 Motta ..... 52/592.4 X
6,240,693 B1 * 6/2001 Komasara et al. ..... 52/592.4 X
6,247,281 B1 * 6/2001 Lin ..... 52/592.4 X
6,272,802 B1 * 8/2001 Berberich ..... 52/592.6 X
6,295,778 B1 * 10/2001 Burt ..... 52/592.6
6,467,229 B2 * 10/2002 Azar ..... 52/589.1
6,564,524 B1 * 5/2003 Gruita ..... 52/590.2 X
2001/0029719 A1 * 10/2001 Azar ..... 52/589.1
2003/0019170 A1 * 1/2003 Donnelly ..... 52/592.6 X
2004/0040234 A1 * 3/2004 Davison et al. ..... 52/271 X

* cited by examiner

*Primary Examiner*—Rodney B. White
(74) *Attorney, Agent, or Firm*—William E. Noonan

(57) ABSTRACT

A modular building system includes a plurality of extruded plastic beams that are stacked and interlocked using a tongue and groove interengagement. Plastic connecting components are provided for interlocking the horizontal beams to a vertical column.

28 Claims, 17 Drawing Sheets

MODULAR BUILDING SYSTEM

RELATED APPLICATION

This application claims the benefit of U.S. Provisional Patent Application Ser. No. 60/362,766 filed Mar. 8, 2002.

FIELD OF THE INVENTION

This invention relates to a modular building system and, more particularly, to a building system that employs modular, foam filled plastic elements that are selectively interengaged and interlocked to construct buildings having a variety of sizes and configurations.

BACKGROUND OF THE INVENTION

Conventional building techniques, featuring, for example, wood frame, precast and/or concrete block construction are relatively complicated and labor intensive. As a result, construction costs continue to escalate.

Traditional log homes remain popular as an alternative to more common building techniques. Nonetheless, wood log construction can also be intricate and time consuming. The individual logs must be precisely cut and shaped. Often a considerable amount of material is wasted in the construction process. Moreover, standard log homes are usually poorly insulated and energy inefficient. The configurations and layouts available using log construction are also quite limited. And because traditional log homes are composed of wood, they are very susceptible to fire damage.

SUMMARY OF INVENTION

It is therefore an object of the present invention to provide an improved modular building system, which enables a house or other building to be constructed relatively quickly and inexpensively and which requires significantly less labor than is required using conventional building techniques.

It is a further object of this invention to provide a modular building system that achieves a high degree of insulation and energy efficiency and which is much more energy efficient than conventional log homes.

It is a further object of this invention to provide a modular building system which addresses and overcomes the problems presented by conventional wood log construction techniques.

It is a further object of this invention to provide a highly efficient modular building system which significantly reduces the waste of construction materials.

It is a further object of this invention to provide a modular building system that enables a wide variety of shapes and sizes of houses and other types of buildings to be conveniently constructed.

It is a further object of this invention to provide a modular building system which conveniently accommodates utility conduits and wiring.

It is a further object of this invention provide a modular building system which is fire resistant, exceptionally strong and durable and resistant to damage from wind storms and other adverse weather elements.

It is a further object of this invention to provide a modular building system which features improved structural integrity over conventional log construction.

This invention features a modular building system including means defining a plurality of elongate, generally horizontally arranged beams, which are stacked to define at least one wall. Each adjacent pair of beams in the stack are interengaged and interlocked. Each beam includes an elongate shell having a central channel formed therethrough. The central channel contains a rigid foam core or some other type of insulating material.

In a preferred embodiment, each adjacent pair of stacked beams are interconnected by tongue and groove means. A longitudinal tongue is formed unitarily in one of the beams. The other beam includes a longitudinal groove that receives the tongue such that the adjoining beams are interengaged.

The stacked beams may include a bottom beam, a top beam and a plurality of intermediate beams. The bottom beam may include a generally flat bottom surface and an opposite upper surface along which a longitudinal tongue is formed. A lowermost intermediate beam may include a groove on its bottom surface that receives the tongue of the bottom beam. The top beam may include a bottom surface having a longitudinal groove, which receives a longitudinal tongue of an uppermost intermediate beam. The top beam include an upper surface having a longitudinal recess, which receives a channel element having a generally U-shaped cross section. Each of the intermediate beams may include a longitudinal tongue formed unitarily along its bottom surface and a longitudinal groove formed along its upper surface.

The stacked beams may be further interlocked by a generally vertical column, which interlockably interengages the stacked beams. In one embodiment, the bottom beam carries, at each end, an end plug that is removably interengaged with the shell of the bottom beam. Likewise, each intermediate beam may carry, at each end, an end plug that is removably interengaged with the beam. Each bottom and intermediate end plug may include a plug shell that accommodates an insulating material. Each plug shell may carry an insertion or locking member that is slidably or otherwise received in a longitudinal slot formed in the vertical column. The insertion members and the slots have complementary, preferably dovetail shapes, which permit the insertion members to be slidably received and locked within the longitudinal slot in the column. As a result, each of the beams in the stack is interlocked to the column. In certain embodiments, the above described plugs may be carried by the bottom beam and the intermediate beams only. The top beam may carry, at each end, an end plug having an upper recess that communicates with the recess of the top beam and a lower groove that communicates with the groove of the top beam. In such embodiments, each plug carried by the intermediate beams may include a lower groove and an upper tongue. The tongue of the uppermost intermediate beam is received in the groove of the plug in the top beam. The top beam end plugs again comprise a shell that contains insulation.

The vertical column may permit two series of stacked beams to be interconnected at a corner. In particular, the column may include a generally rectangular shape and longitudinal slots, as previously described, may be formed at a 90 degree angle on the column. A respective series of stacked beams is interengaged with each of the slots in the above described manner and is thereby interlocked to the column at a 90 degree (or alternative) angle. In such embodiments, a respective pair of top beams may be interconnected at a like angle by a top beam connecting piece. The top beam connecting piece has an angle that is identical to the angle formed between the vertical column slots. The top beam connecting piece includes a central angled portion that interengages a pair of top beam end plugs carried by respective top beams. As a result, the top beams are held at an angle defined by the central angled portion.

The connecting piece may be mounted to the upper end of the central column. An elongate reinforcing bar may be received through aligned openings in the top connecting piece and the column. Additional vertical openings may be formed along the stacked beams. Each such vertical opening may accommodate a respective supporting rod. The upper end of the rod may be received through a corresponding opening in the channel element. The building system may further include door and window structures. The door structure may comprise a pair of elongate generally vertical door jamb elements having longitudinal dovetail grooves formed in opposite sides thereof. An elongate header component may be engagable with upper ends of the vertical door jamb elements. The header element may include an upper surface having a longitudinal tongue that interengages a complementary longitudinal groove of a horizontal beam stacked above the header element. The longitudinal slots of the vertical door jamb elements slidably receive end plug insertion members of a number of the stacked intermediate beams. The slots are shaped to lockably receive the insertion members such that the horizontal beams are locked in interengagement with the vertical jamb elements. The header element may carry header end plugs at each end. Each header end plug includes an opening that contains an insulated material. The bottom of each header end plug includes a groove that interengages the tongue of a beam plug attached to the jamb element below the header plug.

The window structure may include a pair of spaced apart, generally vertical window jamb elements that define the sides of the window. Each window jamb element includes a longitudinal groove that faces outwardly from the window opening. The vertical window jambs include respective grooves formed longitudinally in opposing surfaces of the jambs. Each groove receives a plurality of connecting end plugs that are carried by the horizontal beams. A window header element may be mounted above the upper ends of the window jamb elements. The lower ends of the window jamb elements may be mounted on an elongate window sill element. The window header element may carry a pair of end plugs that are releasably attached to the window header element at respective ends. The window header element end plugs are interengaged with respective horizontal beams in the manner previously described. Once again, the window header element and the plugs may include central channels that contain insulation. The sill element likewise may carry a pair of connecting plugs at respective ends for interengaging respective horizontal beams. The header and sill connecting plugs include tongue and groove constructions for interengaging upper and lower intermediate beams, respectively. As a result, the entire structure is interlocked in a secure manner that achieves optimal structural integrity.

DETAILED DESCRIPTION OF PREFERRED EMBODIMENTS

Other objects, features and advantages will occur from the following description of preferred embodiments and the accompanying drawings, in which.

Figure 1:
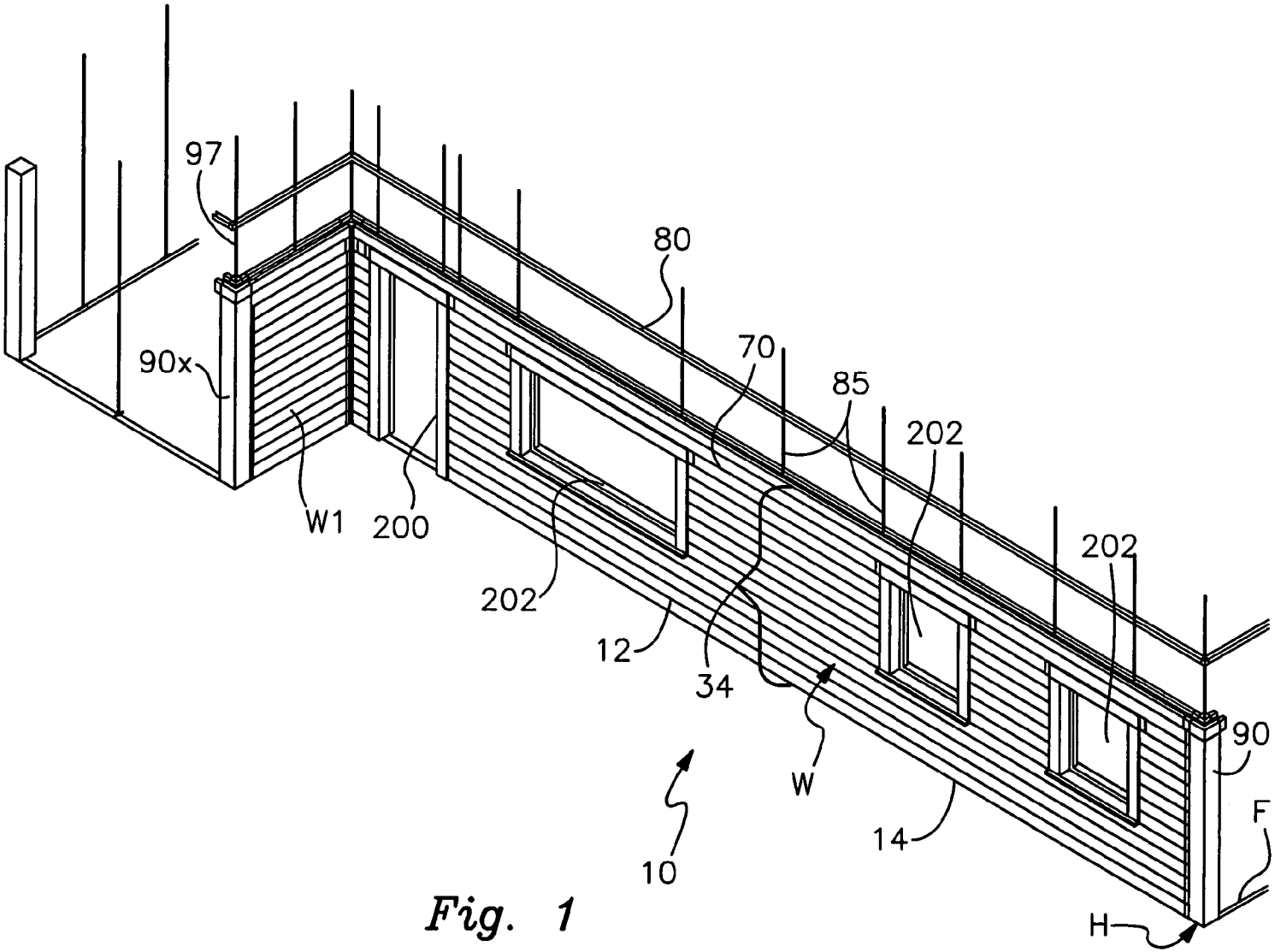
FIG. 1 is a perspective, partially exploded view of a portion of a house constructed using the modular building system of this invention.

There is shown in FIG. 1 a modular building system 10 that is employed to construct a house H. For illustrative purposes, the front and a portion of the garage of house H are shown. However, it should be understood that the principles of this invention may be used to construct any and all of the exterior walls, doors and windows of the house.

System 10 includes a plurality of horizontal beams 12 that are arranged longitudinally side by side and stacked to form a wall W. More particularly, wall W includes a bottom beam 14 that is mounted on a foundation F. Bottom beam 14, shown alone in FIGS. 2 and 3, comprises a polyvinyl carbonate or other synthetic shell or extrusion 16 having a longitudinal channel 18 formed therethrough. The channel contains a rigid foam core that serves as insulation. Each end of beam 14 is engaged and closed by a bottom beam end plug 22. The structure and function of these end plugs are described more fully below. Shell 14 and plug 22, as well as each of the other components of system 10 are extruded, molded or formed by other standard manufacturing techniques. Although the components preferably comprise a lightweight plastic, other durable, lightweight materials, including metals and metal alloys, may be used.

Figure 2:
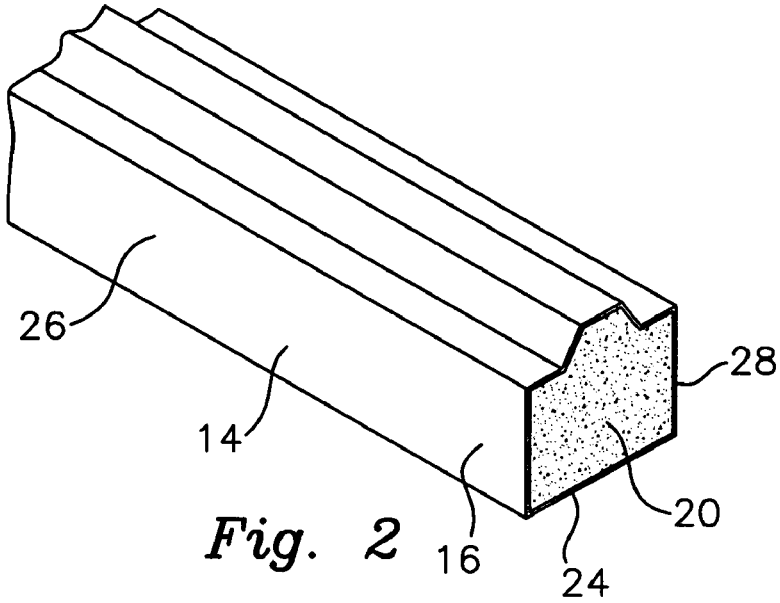
FIG. 2 is a perspective view of the shell and insulating material comprising the bottom beam.
Figure 3:
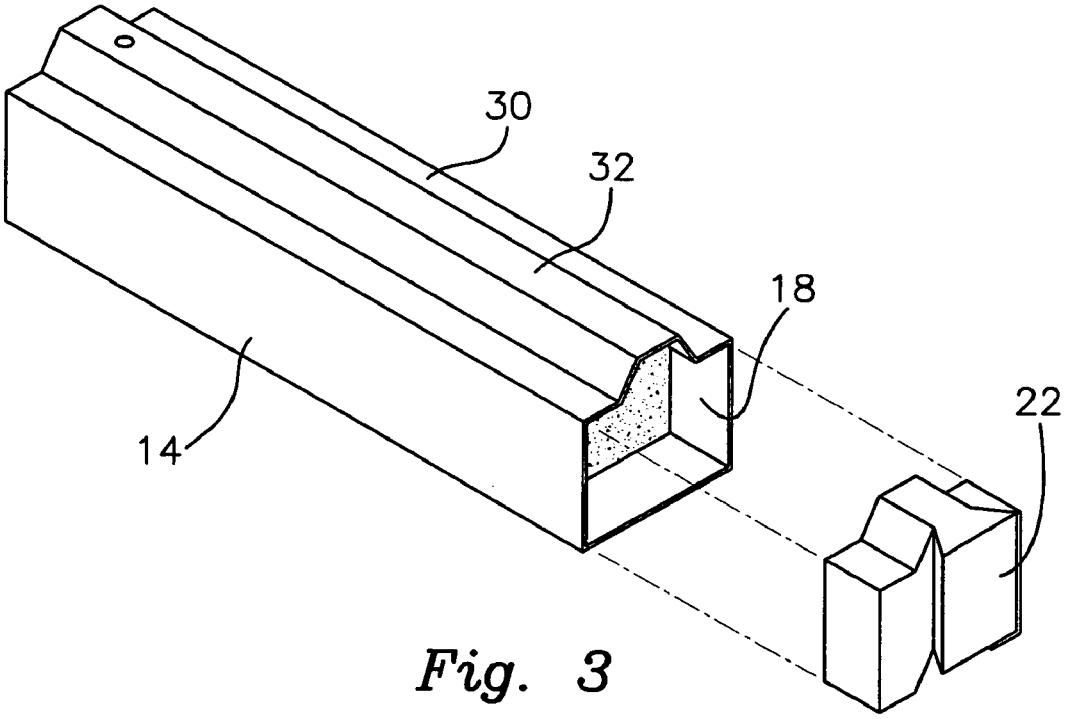
FIG. 3 is a perspective, exploded view of the bottom beam and one of its end plugs.

As illustrated in FIGS. 2 and 3, bottom beam 14 includes a generally flat lower surface 24. This surface flushly interengages and is mounted on the foundation F (FIG. 1). Beam 14 also includes generally flat forward and rearward surfaces 26 and 28, respectively. Upper surface 30 of beam 14 includes a unitary tongue 32 that extends longitudinally for the entire length of the beam. The tongue interengages the groove of an adjoining, intermediate beam in a manner that shall be described below.

Figure 4:
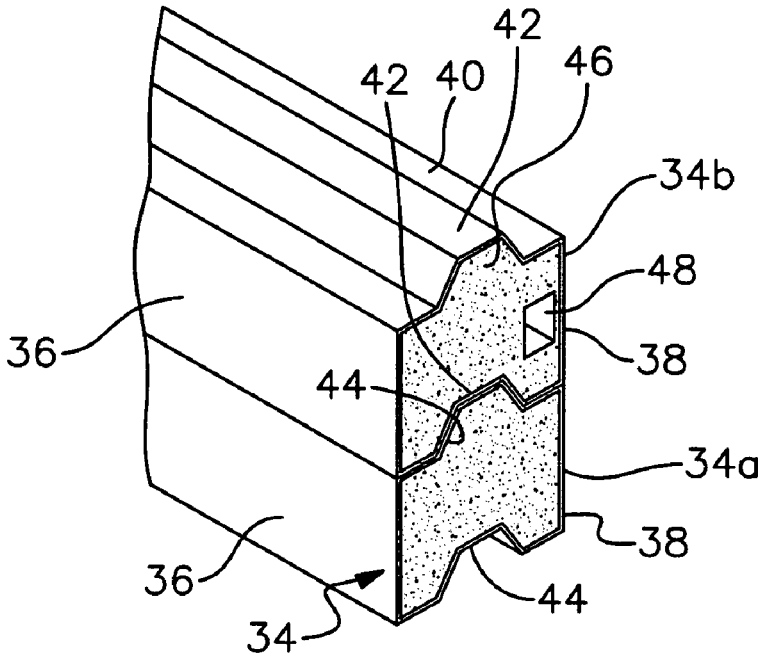
FIG. 4 is a perspective view of a pair of interengaged intermediate beams.

As illustrated in FIG. 1, a plurality of intermediate beams 34 are stacked above bottom beam 14. A representative adjacent pair of stacked intermediate beams 34*a* and 34*b* are shown in FIG. 4. Each of the intermediate horizontal beams includes a flat forward surface 36 and a flat rearward surface 38. The upper surface 40 of each such beam includes a unitary tongue 42 that extends longitudinally for the length of the beam. A similarly shaped groove 44 is formed longitudinally in the bottom surface of each of the beams 34. As best shown in FIG. 4, the tongue of the lower intermediate beam 34*a* is conformably received in the groove 44 of the adjacent, upper beam 34*b*. Each adjoining pair of intermediate beams 34*a* and 34*b* is thereby interengaged and interlocked. Similarly, the groove 44 in the lowermost intermediate beam 34 in stack 12 receives the longitudinal tongue 32 of bottom beam 14, FIGS. 2 and 3. As a result, the lowermost intermediate beam in the stack is interlocked with the bottom beam. A silicone caulk bead or other adhesive may be applied between each of the stacked logs to enhance the strength of the wall.

The intermediate beams 34 again preferably comprise polyvinyl carbonate or another type of plastic extrusion or shell. Each of the intermediate beams contains a rigid, insulating foam material 46, FIG. 4. This may comprise, but is not limited to an expanded foam material such as polystyrene or polyurethane. Certain of the intermediate beams, for example beam 34*b* in FIG. 4, may include a longitudinal chase 48 that accommodates electrical wires, pipes or other utility conduits. Normally, at least some of the intermediate beams, such as beam 34*a*, do not include such a chase.

Figure 5:
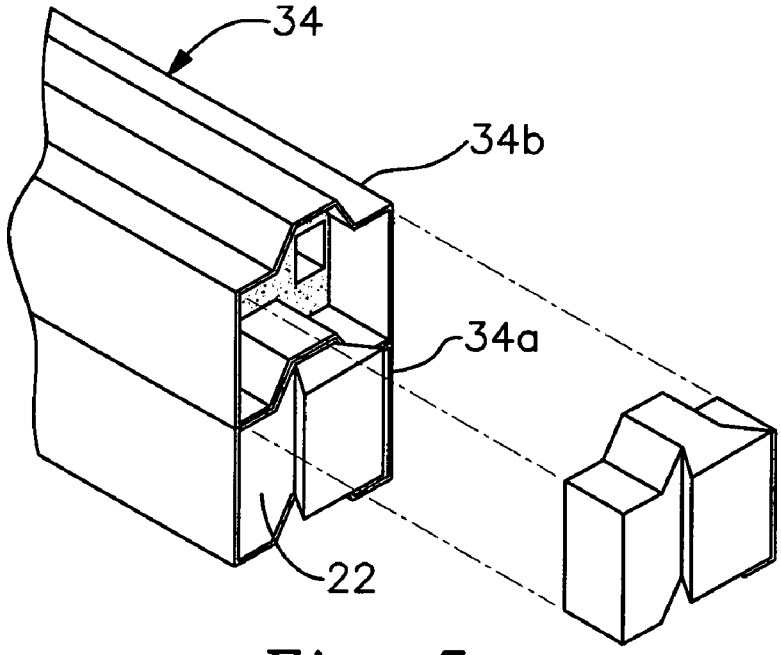
FIG. 5 is a perspective view of a pair of intermediate beams with an end plug attached to one of the elements and a second end plug separated from the other beam.

As best shown in FIG. 5, an end plug 22 may be attached to each end of each intermediate beam 34. As with the bottom beam 14, each end of each beam 34 is typically hollow, i.e. the insulation does not completely fill the end. This permits end plugs 22 to be conveniently inserted into and snugly interengaged with respective ends of beams 14 and 34 so that the interior of each beam is completely closed.

Figure 6:
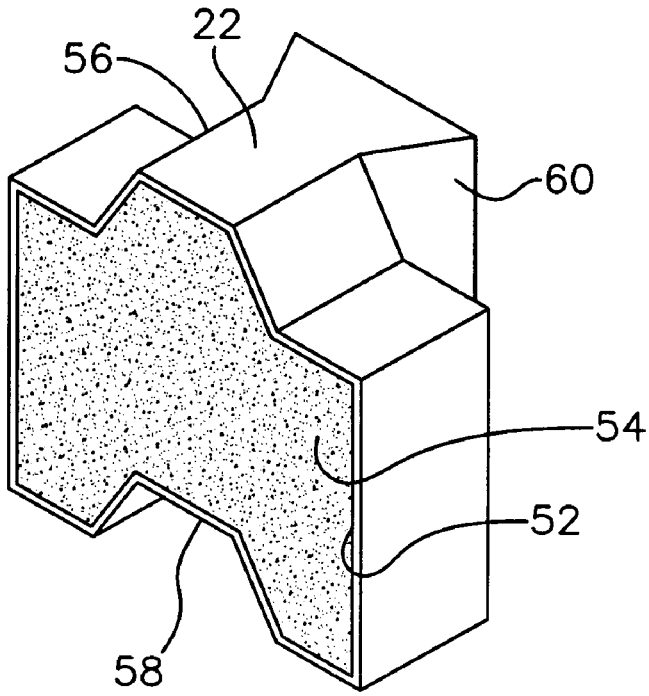
FIGS. 6–8 are various perspective views of the end plug carried by for the intermediate and bottom beams.
Figure 7:
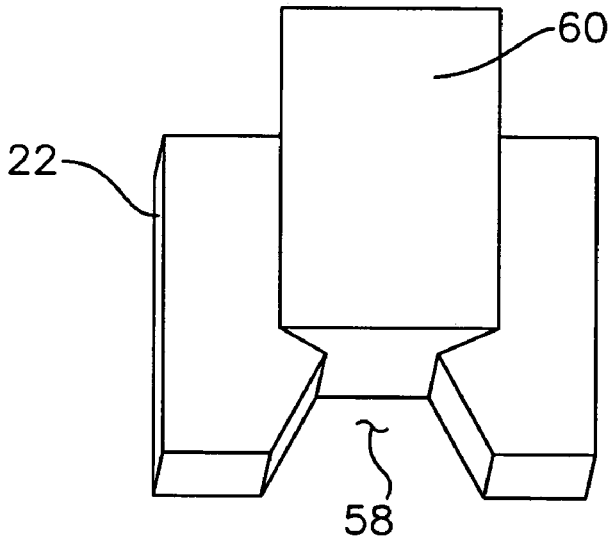
Figure 8:
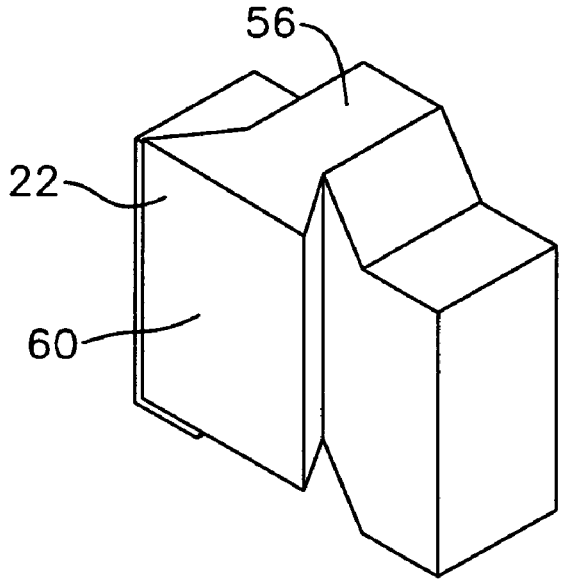

End plug 22 is depicted in greater detail in FIGS. 6–8. Each plug comprises a PVC vacuum formed extrusion or features a similar construction. The plug includes a shell having a central channel 52, which is filled with a foam insulating material 54. The plug has a cross sectional shape resembling the shape of the intermediate beams 34. Specifically, a unitary tongue 56 is formed on the upper surface of plug 22 and a complementary shaped groove 58 is formed in the bottom of the plug. A generally dovetail insertion member 60 is attached unitarily to the outside of the plug. Insertion member 60 interconnects and locks the horizontal beam to vertical connecting component in a manner that is described below. In alternative embodiments, the end plug used for bottom beam 14 may include a shape corresponding to the cross sectional shape of the bottom beam. In such cases, groove 58 is omitted.

Figure 9:
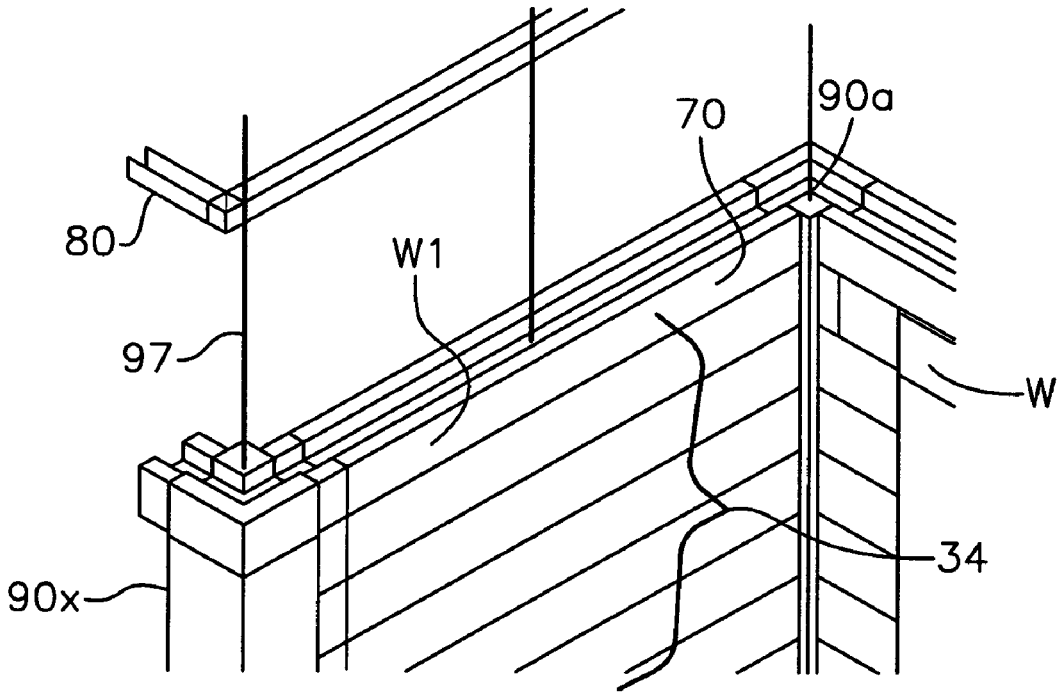
FIG. 9 is a perspective, partially exploded view of a pair of adjoining walls in the house of FIG. 1.
Figure 10:
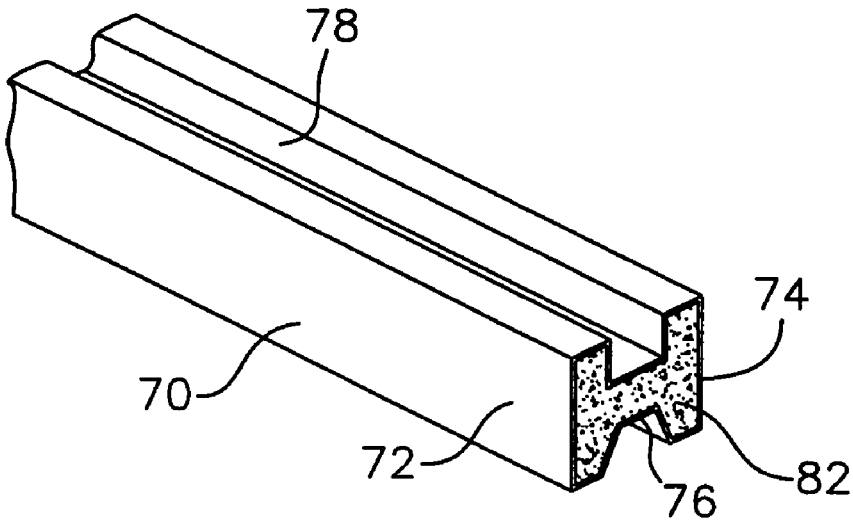
FIG. 10 is a perspective view of the shell and insulating material employed in the top beam.

Referring again to FIG. 1, as well as to FIG. 9, a top horizontal beam 70 is mounted above intermediate beams 34 at the top of stack 12. Top beam 70, shown alone in FIG. 10 has a generally H-shaped cross sectional configuration. More particularly, beam 70 includes generally flat inner and outer surfaces 72 and 74. A longitudinal groove 76 extends along the bottom of beam 70 and a longitudinal recess 78 extends along the top of the beam. Lower groove 76 conformably receives longitudinal tongue 42 of the uppermost Intermediate beam 34, FIGS. 4 and 5, in stack 12. This lockably interengages upper beam 70 with the stack of intermediate beams 34. Upper recess 78 conformably receives a generally U-shaped metal channel 80, shown in FIGS. 1 and 9. Channel 80 may be composed of various metals or metal alloys. Durable plastics may also be employed.

Figure 11:
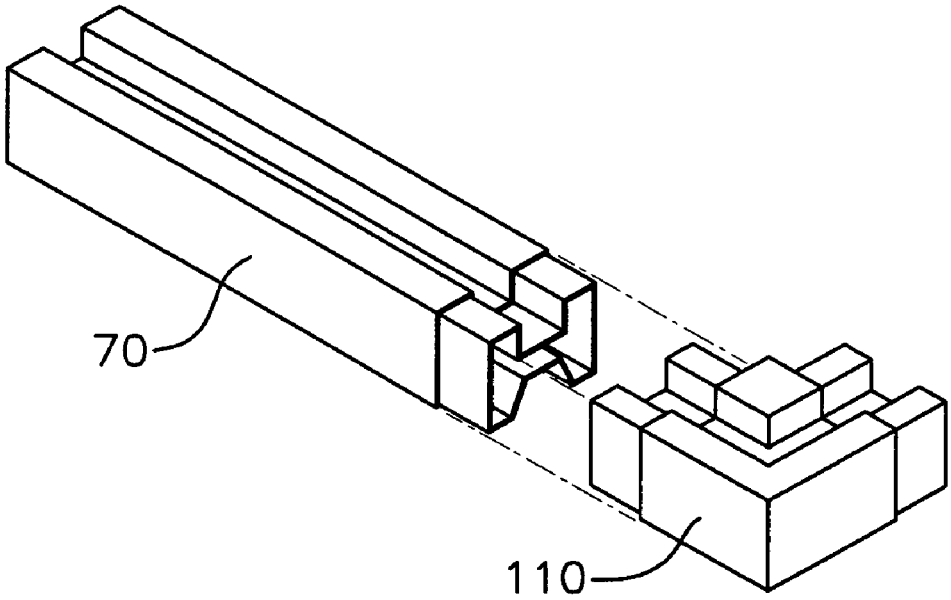
FIG. 11 is a perspective view of the top beam and the top connecting piece.

Top beam 70 again comprises a vinyl or polyvinyl extrusion or alternative plastic compositions. A foam insulating material 82 largely fills the horizontal beam. As best shown in FIG. 11, insulation is omitted from the end of beam 70 so that the beam can accept a connecting plug, as will be described below.

Channel 80 is received by the upper recess 78 of top beam 70, in the manner shown in FIGS. 1 and 9. A plurality of vertical reinforcing bars 85 extend through aligned vertical openings in channel 80 and stacked beams 12. These reinforcing bars are fixed to the foundation F so that a more secure interlocking interconnection is exhibited.

When the bottom, intermediate and top beams are stacked in the previously described manner, they form a wall such as walls W and W1 in FIGS. 1 and 9. These walls include generally flat inner and outer surfaces. Appropriate interior and exterior surface coatings may be applied to the walls as desired. The interlocking tongue and groove construction permits the horizontal beams to interengage flushly and securely. Very little, if any air intrusion is permitted between the adjacent stacked beams.

The stack 12 of horizontal beams is further interlocked along their respective ends. For example, as shown in FIG. 1, some of the beams may extend between respective corners of the building or between the ends of a respective wall. Other beams may extend between individual windows or between a window and a door. Still other beams may extend between a door or a window and an end of the wall or corner of the building. In any event, the two ends of each horizontal beam are typically locked securely in place in the following manner.

Figure 12:
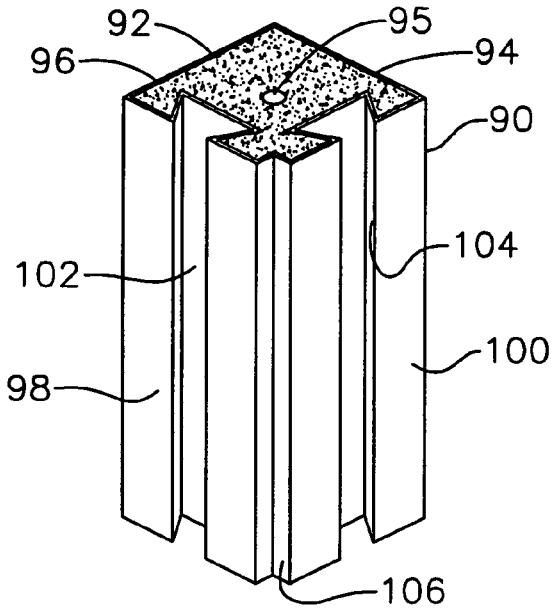
FIG. 12 is a perspective view of the shell and insulating material employed in the vertical column.

As shown in FIGS. 1 and 9, a generally vertical corner post or column 90 is formed at the corner of building H, i.e. at each end of each wall W, W1. An individual column is depicted in FIG. 12. Column 90 comprises an elongate PCV shell or extrusion, which is again filled with a foam insulating material 92. The column includes a pair of flat, vertical sides 94 and 96 that are connected at an angle. In the embodiment described herein, this angle is 90 degrees, although in other embodiments alternative angles may be employed. Column 90 includes two other vertical sides 98 and 100 that maintain a similar angle. A longitudinal slot 102 having a generally dovetail shape is formed in side 98 and a similar longitudinal slot 104 is formed in side 100. A central angle 106 is maintained between sides 98 and 100. This permits connecting plugs 22 to be conveniently attached to column 90 and slid along grooves 102 and 104 in a manner described below. Without angle 106, the end plugs would tend to bind and interfere with each other.

Figure 13:
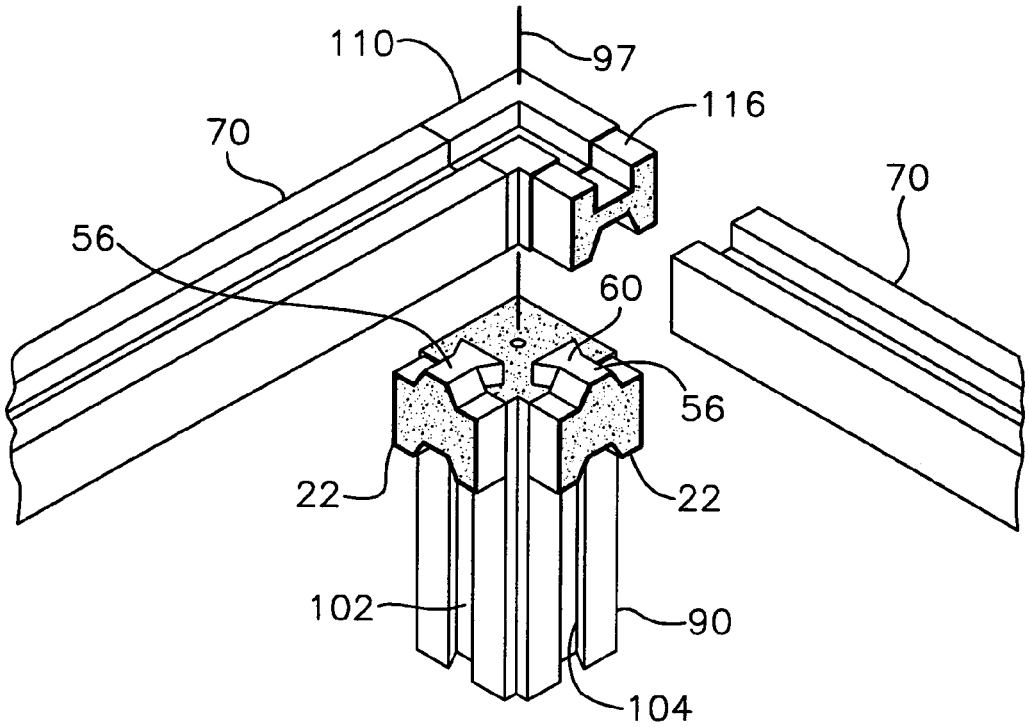
FIG. 13 is a perspective, partly exploded view of the vertical column, a pair of intermediate beam end plugs, a pair of top beams and the connecting piece that joins the top beams at an angle at the upper end of the vertical column.

A vertical hole 95 is formed through insulation 92. This hole receives a reinforcing bar 97, as shown in FIGS. 1, 9 and 13. This reinforcing bar extends through the hole 95 in column 90 and is set in foundation F. As a result, the column 90 is securely positioned on the foundation. The horizontal beams can then be interlockably attached to the column.

Slots 102 and 104 of column 90 are slidably interengaged by respective sets of end plugs 22 in the manner illustrated in FIG. 13. As previously described, an end plug is attached at each end of bottom beam 14 and at each end of each intermediate beam 34. Each of those beams is slidably and interlockably attached to column 90 by simply inserting the insertion member 60 of each beam's end plug 22 into a respective one of the slots 102, 104. As a result, the end plug and beam slide from the top end of the slot vertically downwardly along column 90. The bottom beam 14 is initially attached in this manner and slid to the lower end of the column. Each of the intermediate beams is then engaged with the column in a similar manner.

Two series of stacked beams are engaged with a column 90, in the above described manner to form a corner of house H. One series of beams interengages slot 102 and the other series engages slot 104. The insertion pieces 60 have a dovetail shape that corresponds to the shape of slots 102 and 104. As a result, each beam is securely interlocked in the column. As best shown in FIGS. 1 and 9, column 90 may receive only one series of horizontal beams (such as when the column 90*x* is at a corner of the garage). Alternatively, when two series of beams are attached to column 90, such as illustrated by connecting post 90*a*, the walls W and W1 are formed at perpendicular or other desired angles.

Figure 14:
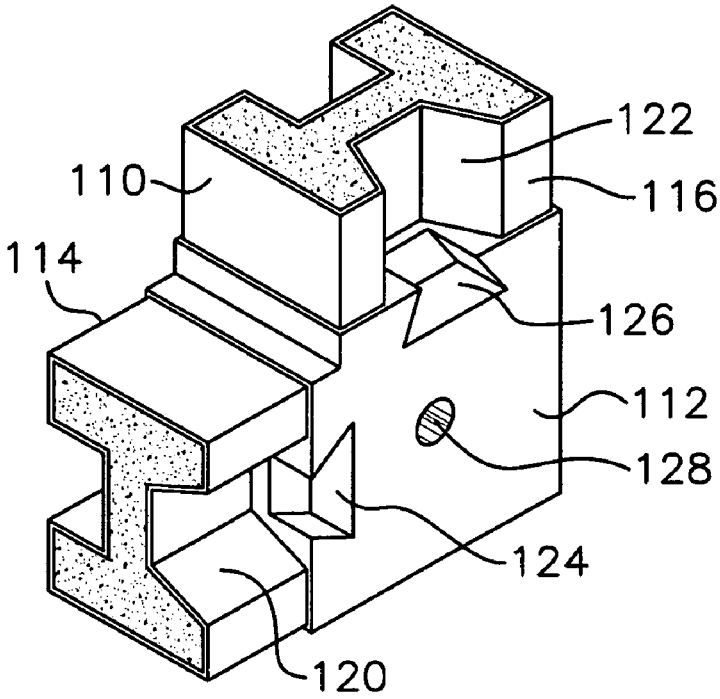
FIGS. 14–16 are various perspective views of the upper connecting piece.
Figure 15:
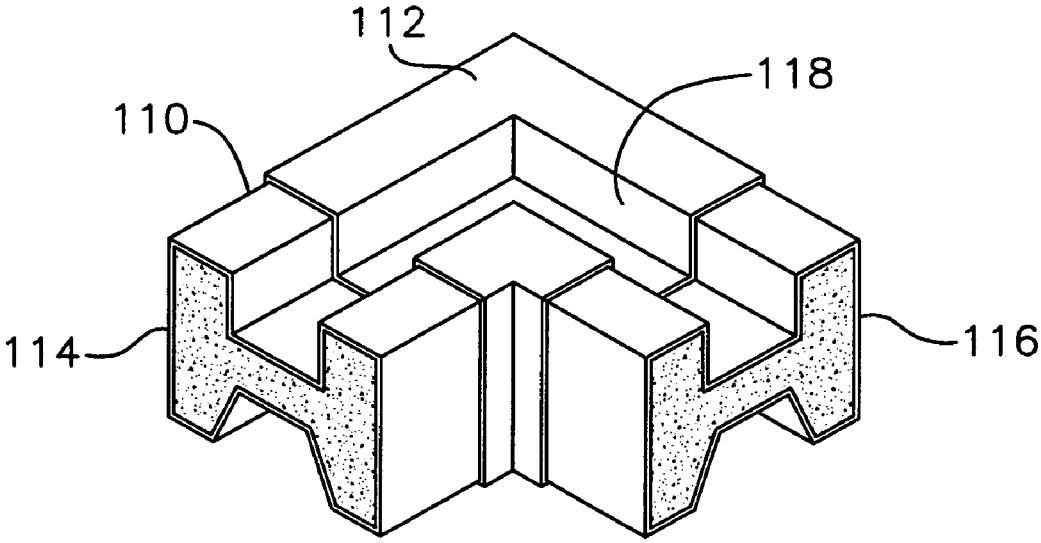
Figure 16:
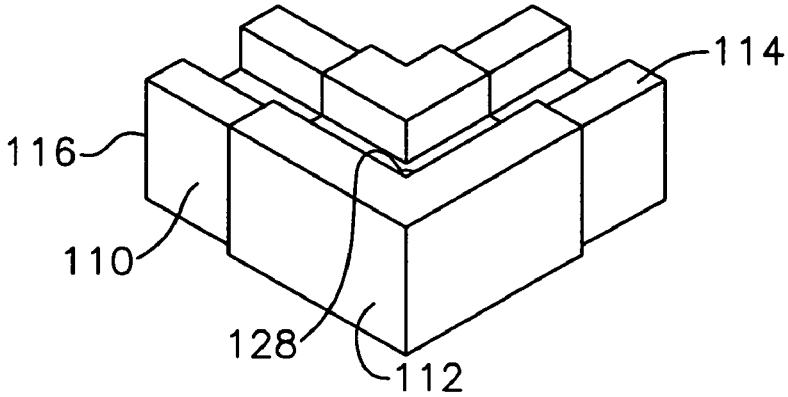

After the bottom and intermediate horizontal beams are attached to the connecting column, the upper beams are installed. As shown in FIGS. 11 and 13, each top beam 70 is interengaged with an angled corner piece 110. This piece is illustrated alone in FIGS. 14–16. Piece 110 includes an angled central portion 112, which defines a desired angle corresponding to the angle between slots 102 and 104 of column 90. In this example, that angle is 90 degrees. A pair of plug portions 114 and 116 is carried by central portion 112 and are directed at 90 degrees relative to one another. As best shown in FIGS. 15 and 16, connecting piece 110 includes an L-shaped upper recess. As best shown in FIG. 14, the plug portions 114 and 116 also include lower grooves 120 and 122, respectively. Central portion 112 further includes dovetail shaped receptacles 124 and 126, which are formed in the bottom surface thereof. A central hole 128 extends vertically through central portion 112. The plug portions have a shape conforming to the shape of top beam 70. Portions 114 and 116 are slightly smaller than beam 70 such that the plug portions are snugly receivable by respective beams 70.

Figure 13A:
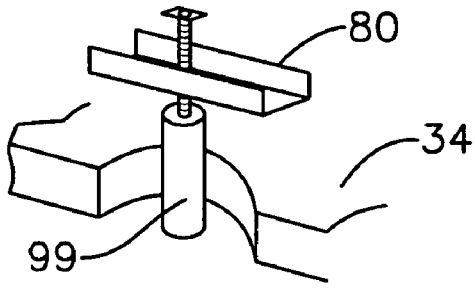
FIG. 13A is a perspective, fragmentary view of the optional standoff component.
Figure 13B:
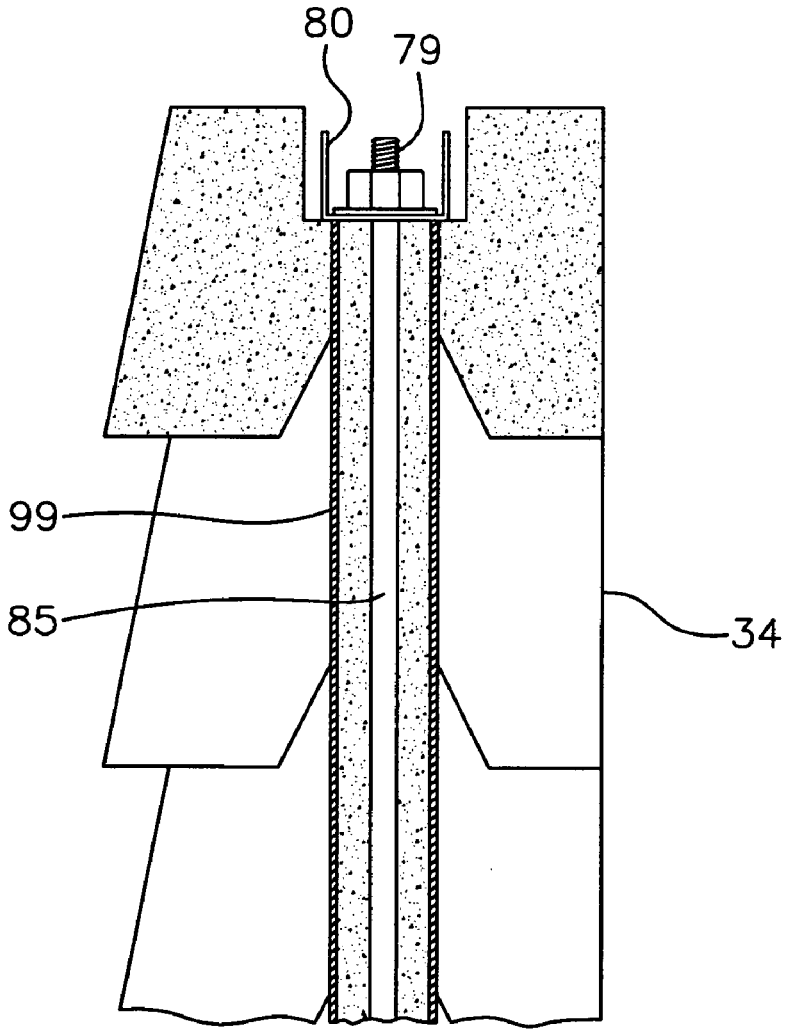
FIG. 13B is an elevational cross sectional view of a representative standoff and support rod for vertically interlocking the horizontal beams.

A pair of top beams 70 are connected by piece 110 in the manner shown in FIGS. 11 and 13. In particular, one of the plug portions 116 is snugly received in an open end of one of the beams 70 and the other plug portion 118 is similarly received in the open end of the other top beam 70. As a result, the top beams 70 are held at a 90 degree angle by piece 110 in the manner shown in FIG. 13. The angle connecting piece 110 is then mounted on vertical connecting post 90. The respective tongues 56 of the uppermost end plugs 22 are received by the grooves 120 and 122 in plug portions 114 and 116. The dovetail insertion members of the uppermost plugs 22 are likewise received by dovetail notches 124 and 126 in central portion 112. As a result, the top beams 70 and connecting piece 110 are securely interlocked to column 90 and its attached beams 34. As previously described, the lower groove 76 of top beam 70 receives the tongue 42 of the uppermost intermediate beam 34. Hole 128 in piece 110 is aligned with hole 95 in column 90. The legs of upper L-shaped recess 118 in piece 110 are aligned with respective upper recesses 78 in top beams 70. A channel 80 extends through each of the aligned recesses and includes holes that align with vertical holes in the walls. A reinforcing rod 85 is inserted through each aligned set of holes. Similarly, reinforcing bar 97 extends through hole 128 in piece 110 and the aligned hole 95 in column 90. Nuts 81 or analogous forms of connection, FIGS. 13A and 13B, are attached to threaded upper ends 79 of the reinforcing rods and tightened against the U-channel to lock the wall to the foundation. Standoffs 99 consisting of tubes or pipes may be disposed about each of the rods and extend upwardly from the foundation through the stacked beams 34 (or alternatively through a corner column). The standoffs oppose the tightening force of the nuts 81 against channel 80. Such standoffs, which can range in diameter from ¾ to 5" also support additional weight exerted upon the wall (e.g. from the roof) and prevent undue compression of the beams.

Figure 17:
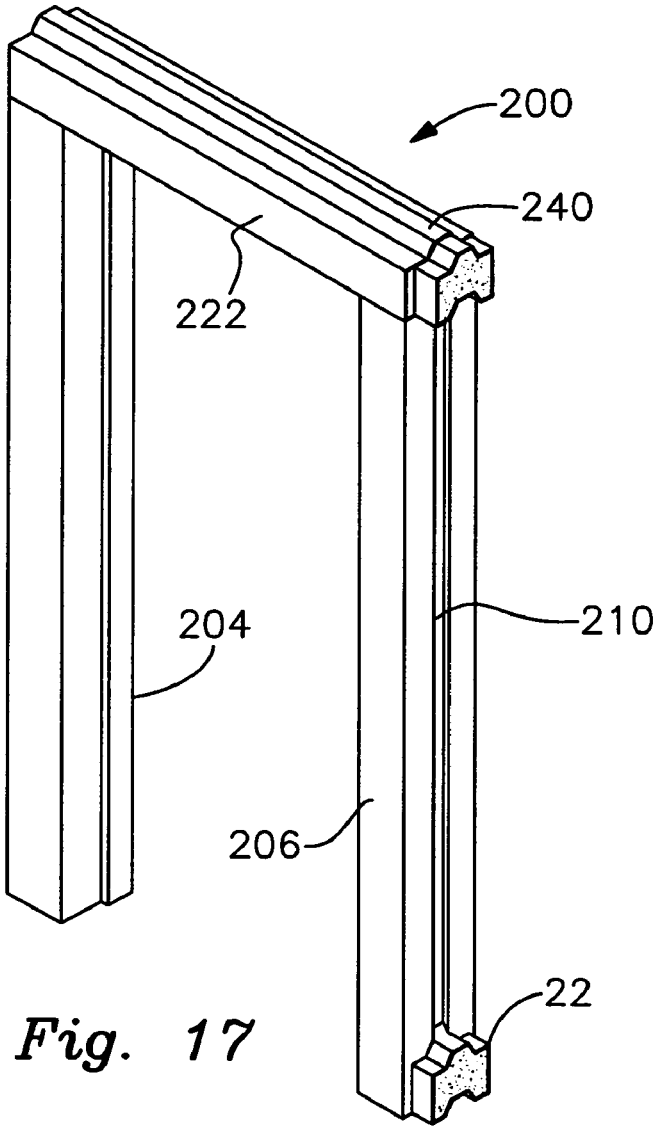
FIG. 17 is a perspective view of a door structure used in the building system of this invention.
Figure 18:
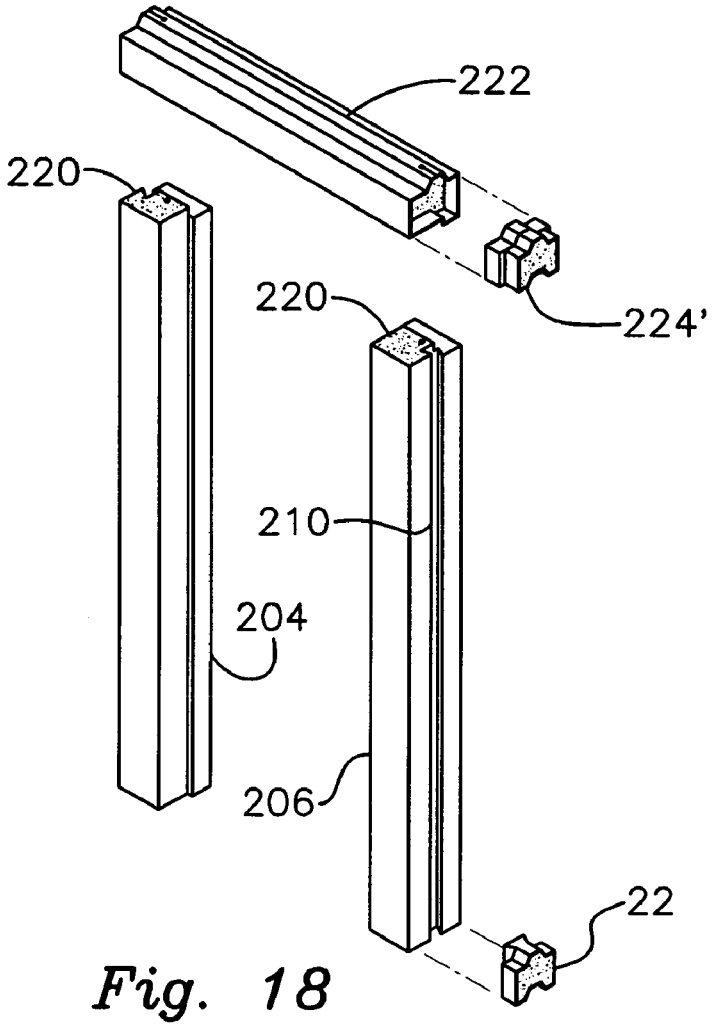
FIG. 18 is an exploded view of the door structure.

In some cases, the horizontal beams of this invention are also held securely in place by a door structure 200 and window structures 202, FIG. 1. The door structure is shown in greater detail in FIGS. 17–20. Specifically, door 200 includes a pair of generally vertical, plastic door jamb elements 204 and 206. Each jamb element includes a respective longitudinal groove 210 having a generally dovetail-shaped cross section. Groove 210 faces outwardly from the passageway of the door. As best shown in FIG. 18, each of the door jambs includes an interior channel that contains insulating foam 220.

Figure 19:
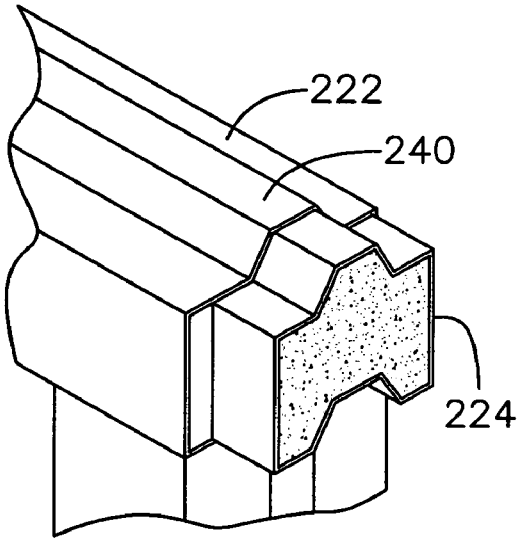
FIG. 19 is a perspective view of the door header element and associated connector for joining the header element to one of the horizontal beams.
Figure 20:
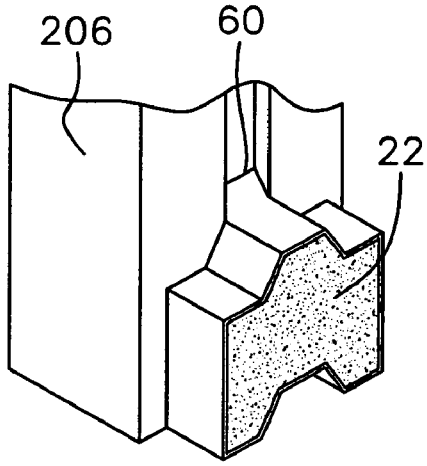
FIG. 20 is a perspective view of the lower end of one of the vertical door jamb elements and a horizontal beam end plug attached to the door jamb element.
Figure 21:
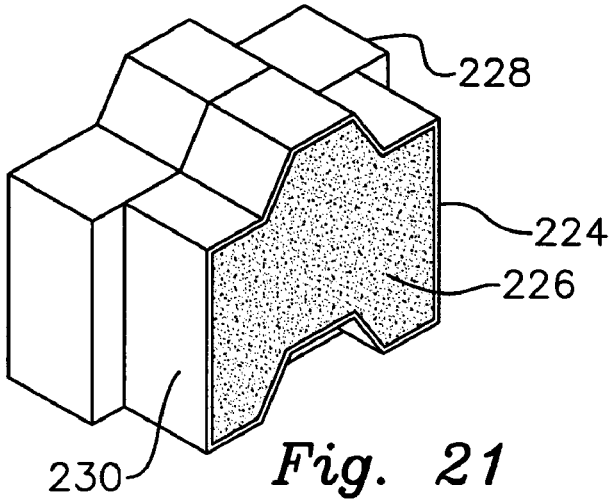
FIGS. 21–23 are various perspective views of the door header connecting plug.
Figure 22:
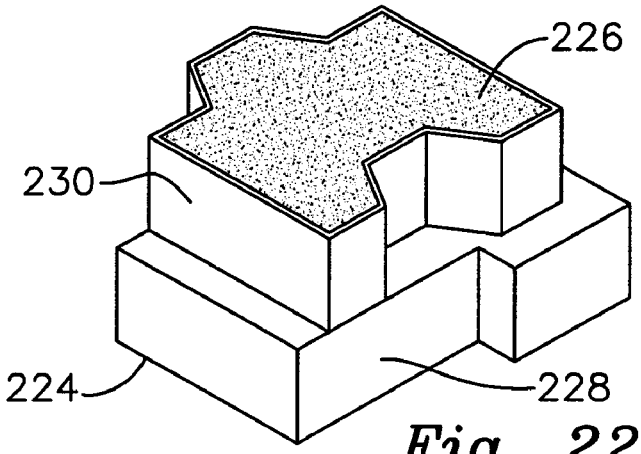
Figure 23:
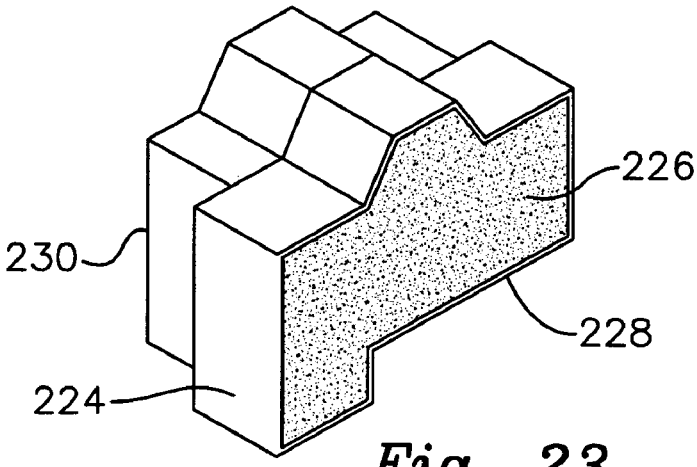

An elongate, generally horizontal header element 222, which likewise includes a foam filled channel, extends across the upper ends of door jamb elements 204 and 206. As best shown in FIG. 18, each end of header element 222 receives a respective header plug 224. This plug, shown alone in FIGS. 21–23, again comprises a plastic shell that is filled with insulating foam 226. Plug 224 includes a first part 228 having a generally L-shaped cross section. Part 228 is snugly received by one end of correspondingly shaped header element 222, in the manner best shown in FIG. 19. Plug 224 likewise includes a second part 230 that has a shape which generally conforms to the shape of a respective intermediate beam 34. Part 230 is snugly received by an open end of an aligned beam 34 and thereby interconnects the header element 222 and an adjacent intermediate beam. Each end of the header element is connected to an adjoining intermediate beam in this manner. As best shown in FIGS. 17, 19 and 20, the header element 222 also includes an upper tongue 240. This tongue is received by a complementary and conformably shaped groove in an intermediate beam located just above the header element. As a result, a flush interlocking interengagement is provided between the header element and the overlying intermediate beam.

A bottom horizontal beam 14 and a number of additional stacked intermediate beams 34 are connected to each of the door jamb elements 204 and 206 in a manner analogous to the fashion in which the beams are interconnected to column 90. As shown in FIGS. 17, 18 and 20, a connecting end plug 22 is slidably interengaged with longitudinal groove 210 of jamb element 206. As previously described, insertion member 60 of plug 22 is slidably received in the dovetail groove 210. The end plug and its attached beam are slid longitudinally along jamb element 206, typically from the top toward the bottom. First the bottom beam is engaged with the jamb element and slid downwardly; then the intermediate beams are successively interengaged in this manner and slid downwardly along the jamb element. Such assembly is performed to attach respective beams to jamb elements 204 and 206. When the assembly is completed, the horizontal beams interengage door 200 in the manner best shown in FIG. 1.

Figure 25:
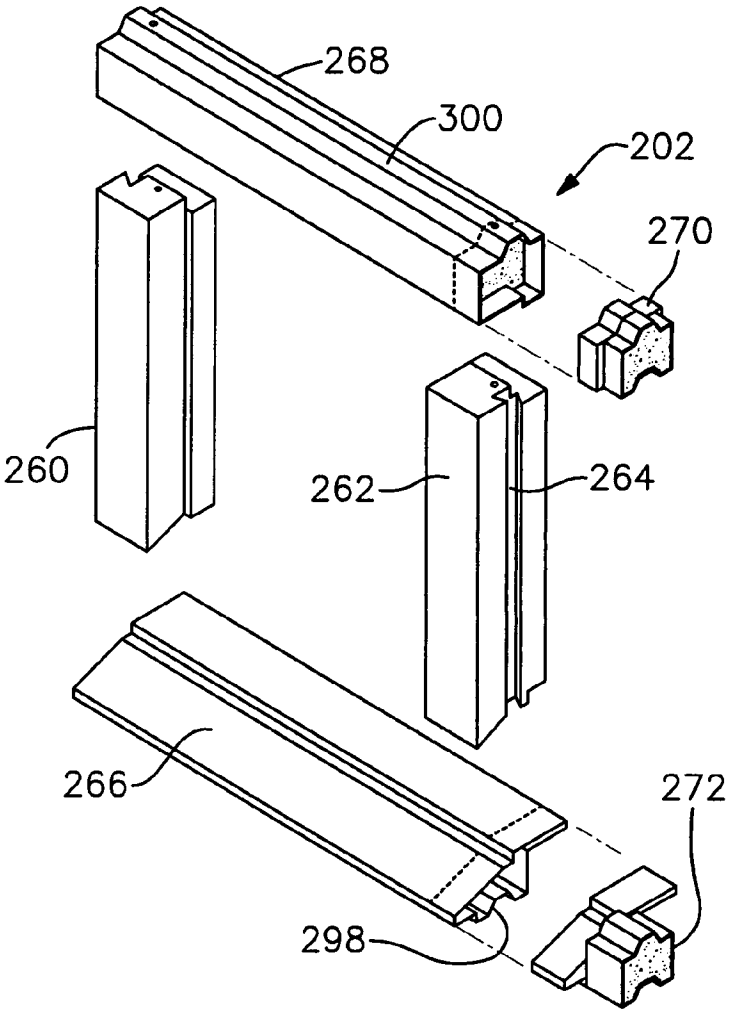
FIG. 25 is an exploded view of the window structure.
Figure 24:
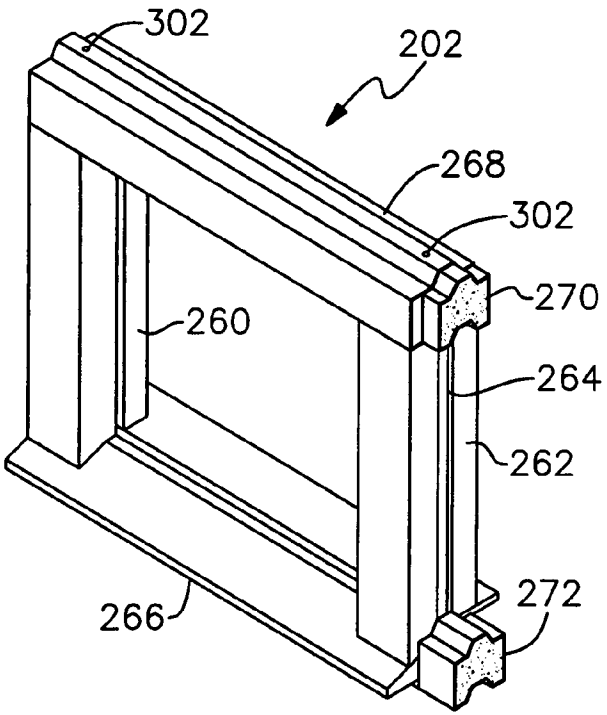
FIG. 24 is a perspective view of a window structure employed in the modular building system of this invention.

A representative window structure 202 is shown in FIGS. 24 and 25. Each window includes a generally parallel pair of vertical window jamb elements 260 and 262. As with the door jambs, each window jamb element includes a longitudinal groove 264 formed in its side surface facing away from the passageway through the window. Only the groove for jamb element 262 is shown in FIGS. 24 and 25. The lower end of elements 260 and 262 engage and are mounted on a sill element 266. A window header element 268 is mounted to the upper ends of window jamb elements 260 and 262. Each of elements 260, 262, 266 and 268 includes a plastic construction and contains insulating foam as previously described.

Figure 26:
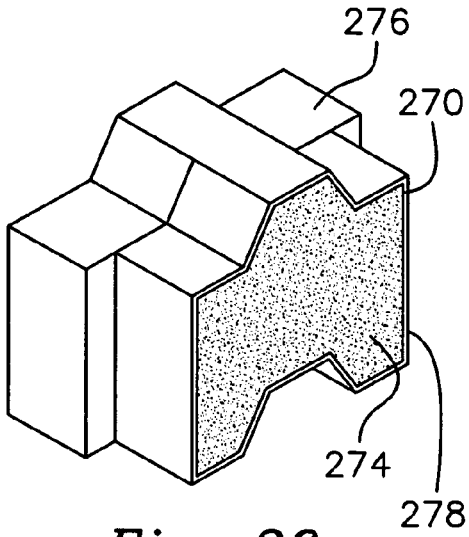
FIGS. 26–28 are various perspective views of the plug for interconnecting the window header and an adjoining horizontal beam.
Figure 27:
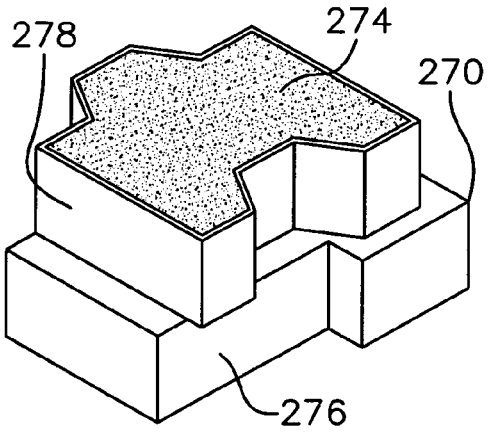
Figure 28:
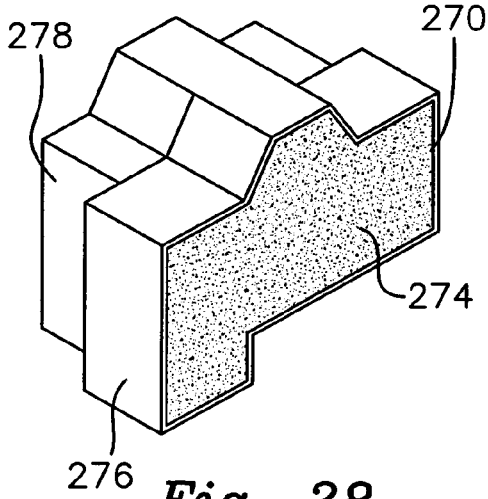

Connecting plug elements 270 and 272 interconnect window header 268 and window sill 266 with respective horizontal beams 34. The plastic header plug 270, shown alone in FIGS. 26–28 is filled with a foam 274. As with the door header plug, the window plug 270 includes a first portion 276 that is conformably received by and interengaged with the open end of window header element 268 and a second portion 278 that is conformably received by and interengaged with an open end of a respective horizontal beam. As a result, header element 268 is joined to an adjacent one of the intermediate beams. A similar connecting plug 270 is connected at the opposite end of header element 268 to accommodate another beam 34.

Figure 29:
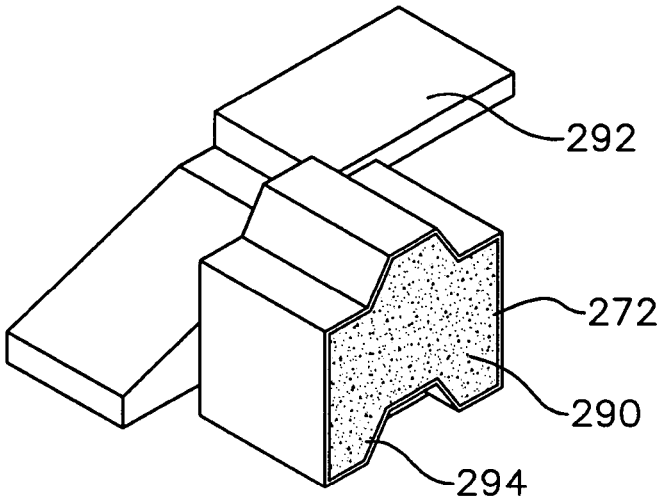
FIGS. 29–31 are various perspective views of the plug for interconnecting the window sill and an adjoining horizontal beam.
Figure 30:
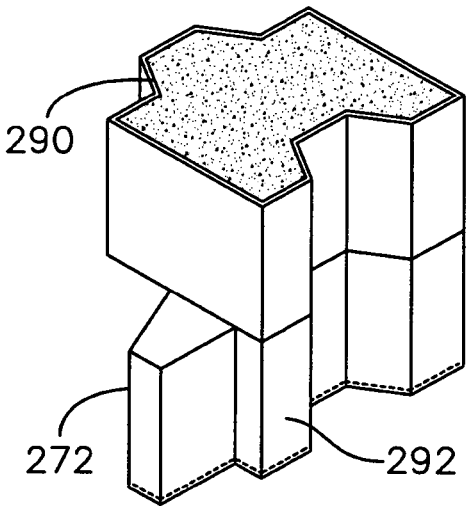
Figure 31:
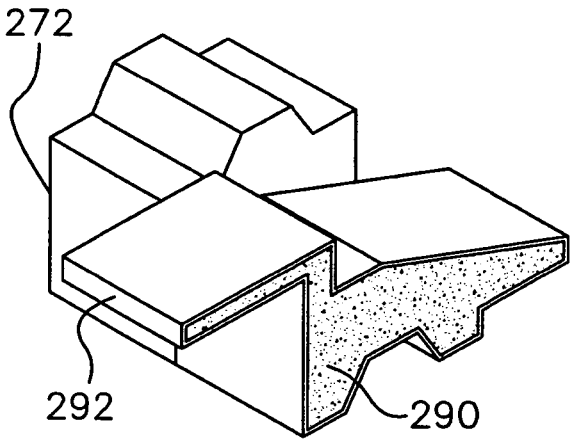

The horizontal window sill 266 is likewise interconnected to a pair of aligned intermediate beams 34. This is accomplished by still connecting plug 272, which is shown alone in FIGS. 29–31. Plug 272 accommodates insulating foam 290. The sill connecting plug includes a first portion 292 having a shape that generally conforms to the shape of the window sill. Plug 272 includes a second portion 294, which has a shape generally conforming to that of adjoining horizontal beams 34. Portion 292 snugly and releasably fits in the open end of sill 266 and portion 294 similarly fits in the open end of an adjoining beam 34, FIG. 5. As a result, an intermediate beam 34 is securely joined to one end of sill 266. A second beam is similarly connected to the other end of the sill.

Sill 266 includes a groove 298, FIG. 25, which interengages the tongue of an intermediate beam 34 disposed immediately beneath the window. Header 268 similarly includes a tongue 298, which interengages a complementary groove in an overlying beam 34. This form of interengagement is analogous to the interlocking interengagement previously described in connection with the stacked beams, as well as the door header. It provides a very rigid interlocking assembly wherein the windows are held securely within the walls. As shown in FIG. 24, vertical holes 302 may be formed through the header, jamb elements and sill to accommodate respective vertical reinforcing bar that extend from the top to the bottom of the wall.

Figure 32:
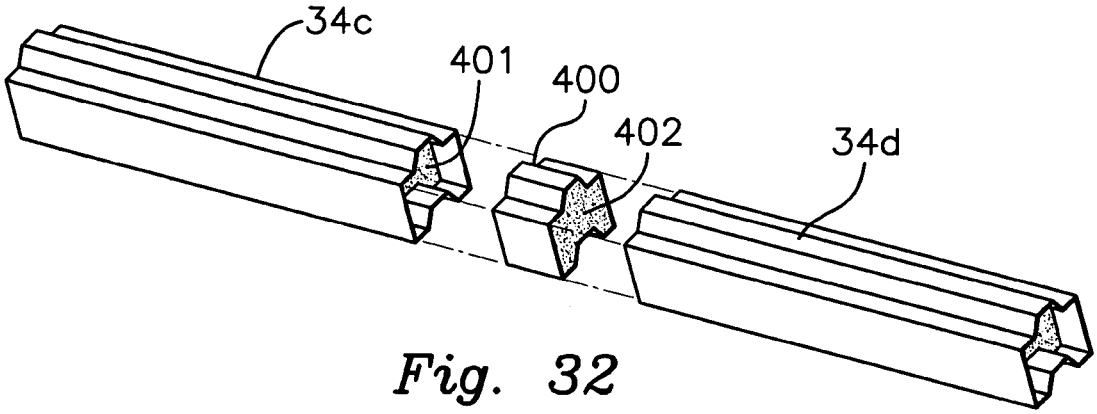
FIG. 32 is an exploded view of a pair of horizontal beams and a plug for releasably connecting those beams.
Figure 33:
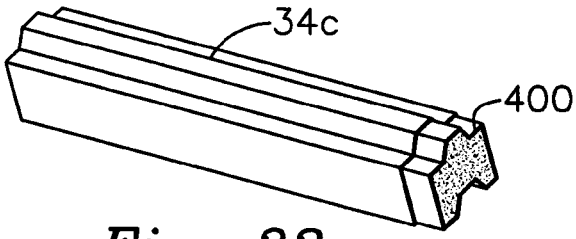
FIG. 33 is a perspective view of a horizontal beam with a connecting plug attached thereto.
Figure 34:
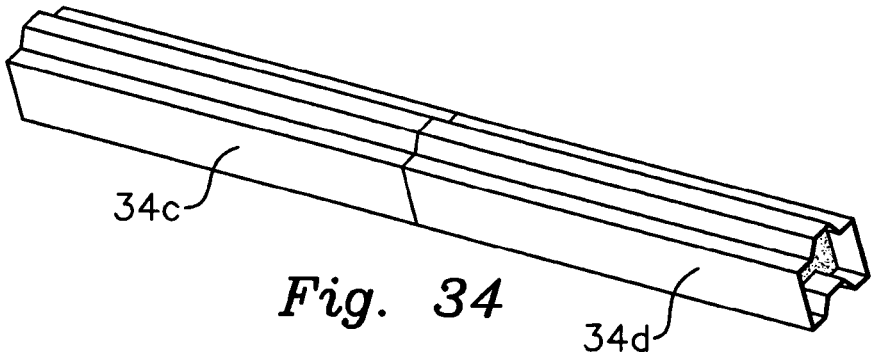
FIG. 34 is a perspective view of a pair of horizontal beams that are releasably joined by the plug illustrated in FIGS. 32 and 33.

It should be understood that, in certain embodiments, the horizontal beams may extend in one piece between respective interlocking components (e.g. columns 90, door jamb elements 102, 104, window jamb elements 260,262, headers 222, 268 and sill 266). Alternatively, the horizontal beams may be formed in smaller segments. As shown in FIGS. 32–34, a pair of elongate intermediate beams 34*c* and 34*d* containing insulation 401 may be interconnected by a connecting plug 400. Beams 34*c* and 34*d* have cross sectional shapes and constructions identical to the intermediate beams previously described. Connecting plug 400 contains insulating material 402. The plug has a shape that conforms to the shape of the beams 34*c* and 34*d* but is slightly smaller so that it snugly fits in the open ends of beams 34*c* and 34*d*, respectively. Plug 400 is inserted in one end of beam 34*c* in FIG. 33. Adjoining horizontal beam 34*d* is then similarly engaged with plug 400 by inserting the plug into an open end of beam 34*d* so that the adjoining beams abut and are connected flushly end to end in the manner shown in FIG. 34. Any number of horizontal beams may be joined end to end in this fashion. Analogous construction may be employed, as well, for the top and bottom beams 14 and 70, respectively. In each case a snugly fitting and generally conforming connecting plug should be used for holding together the adjoining beams.

The end plugs facilitate expansion of the beams. The plugs may be secured to the ends of beams by silicone or other watertight adhesive. This permits the plugs to "float" in the beams and accommodate expansion of the foam when high temperatures are experienced.

Figure 35:
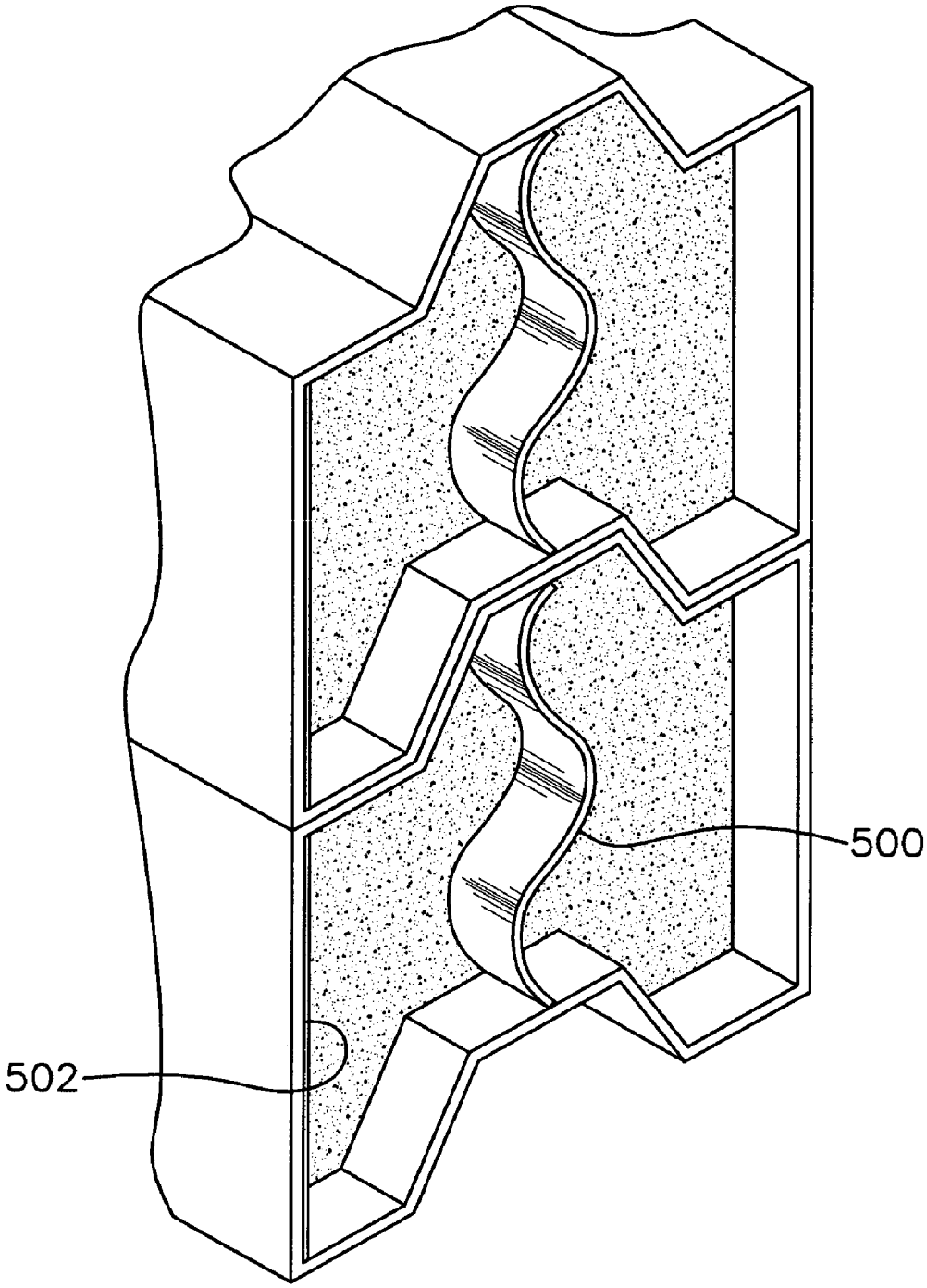
FIG. 35 is a perspective, fragmentary view of a beam component utilizing an internal reinforcing component.

As shown in FIG. 35, reinforcing material, such as serpentine metal components 500 and flat components 502 may be inserted into any of the components of the system to provide increased strength. This may be desirable, for example, in the headers and anchor points for doors and windows. The reinforcing components are installed prior to the application of foam. Components 500, 502 may comprise plastic, sheet metal, fevlar and other high strength materials.

Accordingly, this invention provides a system for quickly and conveniently manufacturing a building and, more particularly, the walls, doors and windows of a building. The system employs modular components that may be quickly and conveniently measured, cut to desired lengths and assembled in a wide variety of desired configurations using the various connecting components described herein. The adjoining stacked horizontal beams, as well as the interengaged door, window, column and corner components are securely interlocked by an effective tongue and groove construction. As a result, the finished building is very durable and able to withstand strong wind storms and other adverse weather conditions. The tongue and groove interengagement between adjoining beams in the wall also virtually eliminates air intrusion. This, combined with the foam insulation that fills of the plastic beams, plugs and other structural components achieves a highly energy efficient insulated structure. The beams can be cut to desired lengths and configured in virtually any desired manner. Virtually no material is wasted. By using the technique of this invention, considerably less time and expense will be required to construct a house than are presently required using conventional building techniques. Considerable cost savings are thus realized.

From the foregoing it may be seen that the apparatus of this invention provides for a modular building system and, more particularly, to a building system that employs modular, foam filled plastic elements that are selectively interengaged and interlocked to construct buildings having a variety of sizes and configurations. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A modular building system comprising:

a foundation;

a plurality of elongate, generally horizontally arranged beams, each beam including an outer shell portion and a distinct thermal insulating substance contained within said shell portion, said beams being stacked in substantial alignment with one another and interlocked to define a wall, said beams being interlocked such that said beams are restricted in moving vertically, as well as horizontally in both longitudinal and lateral directions, relative to one another; and a vertical interlocking assembly including a plurality of elongate, generally vertically arranged rods, each rod disposed through a respective series of aligned holes in said stacked beams, each rod having a lower portion fixed to said foundation and an upper portion carrying a threaded connector that operably interengages an upper horizontal surface of said stacked beams, said threaded connector being selectively tightened to exert a laterally compressive and vertically interlocking force upon said stacked beams in said wall.

2. The system of claim 1 further including a vertical column for interengaging and interlocking said stacked beams.

3. The system of claim 2 in which each beam carries a removable end plug, said column and each said end plug including complementary connectors that are releasably interengaged to interlock said plug and its associated beam to said column.

4. The system of claim 3 in which said complementary connectors include an insertion member formed in one of said column and said plug and a slot formed in the other of said column and said plug, said insertion member vertically slidable and horizontally locked within said slot.

5. The system of claim 3 in which said end plugs include juxtaposed end plugs carried by adjacent stacked beams at corresponding ends of said beams, said juxtaposed end plugs including complementary tongue and groove connecting elements for interlocking said juxtaposed end plugs.

6. The system of claim 1 further including a standoff disposed within said aligned series of holes for opposing and limiting the laterally compressive force exerted by said threaded connector upon said beams.

7. The system of claim 6 in which said stacked beams include a top beam having an upper surface that includes a longitudinal recess that receives a generally U-shaped channel, said channel interengaging said threaded connector and said standoff for transmitting the laterally compressive force to said stack of beams and said standoff when said threaded connector is tightened.

8. The system of claim 7 in which said standoff includes a tube disposed about said rod and extending upwardly from said foundation to engage a lower surface of said U-shaped channel.

9. A modular building system comprising:

a plurality of elongate, generally horizontal beams, each beam including an outer shell portion and a distinct thermal insulating substance contained within said shell portion, said beams being stacked in substantial alignment with one another and interlocked to define a wall;

a generally vertical column for interengaging and interlocking said stacked beams, each beam carrying an end plug, said column and each end plug including complementary connectors that are releasably engaged to interlock said plug and its associated beam to said column, said complementary connectors including an insertion member formed in one of said column and said plug and a slot formed in the other of said column and said plug, said insertion member and said slot having respective profiles that allow said insertion member to slide vertically within said slot and that lock said insertion member horizontally in said slot such that said beams are slidable vertically and locked horizontally within said column.

10. The system of claim 9 in which said slot and said insertion member include complementary dovetail shapes.

11. The system of claim 9 in which said vertical column includes a pair of longitudinal connectors arranged on said column at a selected angle to one another, one of said longitudinal connectors lockably interengaging complementary vertical connectors carried by respective end plugs attached to a first series of said stacked beams and the other said longitudinal connector lockably interengaging complementary vertical connectors carried by respective end plugs attached to a second series of said stacked beams to support said first and second series of stacked beams at said selected angle.

12. The system of claim 11 in which each said series of stacked beams includes a top beam, and further including a top beam connecting piece having a central angled portion that includes said selected angle and interengages end plugs carried by said respective top beams to hold said respective top beams at said selected angle.

13. The system of claim 12 in which said connecting piece is mounted to an upper end of said column.

14. The system of claim 13 in which said connecting piece and said columns have corresponding aligned openings for receiving an elongate reinforcing bar.

15. The system of claim 9 further including a door structure having a pair of elongate, generally vertical door jamb elements, each having a vertical connector, at least some of said beams carrying end plugs having vertical connectors that interengage said longitudinal doorjamb connectors.

16. The system of claim 15 in which each of said door header element and said beam end plug includes an outer shell accommodating a distinct thermal insulation.

17. The system of claim 15 in which, said door structure further including an elongate header component that is engagable with upper ends of said jamb elements, said header component having a connector that is releasably engagable with a complementary connector of an elongate beam stacked above said header element.

18. The system of claim 17 in which said door header includes an upper horizontal connector for lockably interengaging a complementary lower horizontal connector carried by an elongate beam stacked upon said door header.

19. The system of claim 17 in which said header element includes an outer shell containing a distinct thermal insulation, said header element carrying header end plugs at each end thereof, each header end plug including a lower connector that lockably interengages a complementary upper connector attached to the end plug of a beam engaged with a doorjamb element immediately below said header element.

20. The system of claim 9 further including a window structure that comprises a pair of spaced apart, generally vertical window jamb elements defining sides of said window structure, each window jamb element including a longitudinal vertical connector, at least some of said beams carrying beam end plugs having respective vertical connectors that lockably interengage said longitudinal, vertical window jamb connectors.

21. The system of claim 20 further including a window header element mounted above the upper ends of said window jamb elements and carrying a pair of connecting plugs at respective ends thereof for joining said window header element at each end thereof to respective beams, each said window header connector plug including a horizontal connector that lockably interengages a complementary horizontal connector attached to the end plug of a beam engaged with a window jamb element immediately below said window header element.

22. The system of claim 21 in which each of said window header element and said beam end plug includes an outer shell accommodating a distinct thermal insulation.

23. The system of claim 21 further including an elongate sill, which carries a pair of connecting plugs at respective ends thereof, said connecting plugs having horizontal connectors for lockably interengaging complementary horizontal connectors carried by respective beam end plugs.

24. The system of claim 23 in which said window sill element includes a lower horizontal connector for lockably interengaging a complementary upper horizontal connector carried by an elongate beam immediately underlying said sill element.

25. The system of claim 21 in which said window header includes an upper horizontal connector for lockably interengaging a complementary lower horizontal connector carried by an elongate beam stacked upon said door header.

26. The system of claim 9 in which said end plug is secured to said beam by an adhesive that allows said plug to float within said beam in response to temperature change.

27. A modular building system comprising:

a foundation;

a plurality of elongate, generally horizontally arranged beams, each beam including an outer shell portion and a distinct thermal insulating substance contained within said shell portion, said beams being stacked in substantial alignment with one another and interlocked to define a wall, said beams being interlocked such that said beams are restricted in moving vertically, as well as horizontally in both longitudinal and lateral directions, relative to one another;

a vertical interlocking assembly including a plurality of elongate, generally vertically arranged rods, each rod disposed through a respective series of aligned holes in said stacked beams, each rod having a lower portion fixed to said foundation and an upper portion carrying a threaded connector that interengages an upper surface of said stacked beams, said threaded connector being selectively tightened to exert a laterally compressive and vertically interlocking force upon said stacked beams in said wall;

said shell portion of at least one of said beams including a tongue and said shell portion of an adjacent stacked beam including a complementary groove for receiving said tongue to interlock said adjacent stacked beams; and a generally vertical column for interengaging and interlocking said stacked beams, each beam carrying an end plug, said column and each end plug including complementary connectors that are releasably engaged to interlock said plug and its associated beam to said column, said complementary connector including an insertion member formed in one of said column and said plug and a slot formed in the other of said column and said plug, said insertion member and said slot having respective profiles that allow said insertion member to slide vertically within said slot and that lock said insertion member horizontally in said slot such that said beams are slidable vertically and locked horizontally within said column.

28. The system of claim 27 further including a chase formed longitudinally through said insulating substance in at least one of said beams for accommodating utilities therethrough.

* * * * *